US006511384B1

(12) United States Patent
Villacorta

(10) Patent No.: US 6,511,384 B1
(45) Date of Patent: Jan. 28, 2003

(54) GOLF DEVICE

(76) Inventor: Adrian V. Villacorta, 4106 Birchton, Houston, TX (US) 77080

( * ) Notice: Subject to any disclaimer, the term of this patent is extended or adjusted under 35 U.S.C. 154(b) by 0 days.

(21) Appl. No.: 09/981,196

(22) Filed: Oct. 15, 2001

(51) Int. Cl.[7] ..... A63B 53/06
(52) U.S. Cl. ..... 473/257; 473/200
(58) Field of Search ..... 473/200, 569, 473/257, 351, 595

(56) References Cited

U.S. PATENT DOCUMENTS

| | | | | |
|---|---|---|---|---|
| 2,884,254 | A | 4/1959 | Miner | 273/183 |
| D220,769 | S | 5/1971 | LaHue | D34/5 |
| D259,111 | S | 5/1981 | Kinney | D11/157 |
| 4,278,254 | A | 7/1981 | Simjian | 273/183 |
| 4,402,511 | A | 9/1983 | Simjian | 273/183 |
| D273,031 | S | 3/1984 | Simjian | D21/234 |
| 4,494,757 | A | 1/1985 | Simjian | 273/183 |
| 4,664,387 | A | 5/1987 | Tardiff | 273/183 |
| 5,013,046 | A | 5/1991 | Koch | 273/213 |
| D385,937 | S | 11/1997 | Lee | D21/234 |
| D386,548 | S | 11/1997 | Cullen, III | D21/205 |
| D411,268 | S | 6/1999 | Sullivan | D21/709 |
| D411,599 | S | 6/1999 | Sullivan | D21/709 |
| 5,916,044 | A | 6/1999 | Shimosaka et al. | 473/384 |
| 6,001,033 | A | 12/1999 | Tucker | 473/409 |
| 6,004,220 | A | 12/1999 | Razanno | 473/200 |
| 6,019,685 | A | 2/2000 | Fonseca et al. | 473/265 |
| 6,129,639 | A | 10/2000 | Brock et al. | 473/260 |
| 6,155,569 | A | 12/2000 | Horiuchi et al. | 273/317 |
| 6,162,136 | A | 12/2000 | Aoyama | 473/383 |
| 6,179,721 | B1 | 1/2001 | Bevan | 473/160 |
| 6,179,727 | B1 | 1/2001 | Giordano | 473/330 |
| 6,197,721 | B1 | 3/2001 | Didillon et al. | 502/326 |
| 6,231,459 | B1 | 5/2001 | Pettigrew et al. | 473/351 |
| 6,248,021 | B1 | 6/2001 | Ognjanovic | 473/131 |
| 6,248,022 | B1 | 6/2001 | Steyn | 473/162 |

OTHER PUBLICATIONS

Rockline, Inc., *Rockline™ Putting Trainer Web Page* (http://www.puttingtrainer.com/), pp. 1–3, 2000.
MatchPlay, Inc., *Putting Mat Web Page* (http://www.puting-mat.com), p. 1, 1997.
Boom, Golf, *Boomerang Ball Returner Web Page* (http://www.boomgolf.com/main.html), p. 1, Jul. 1, 2000.
Dr. Putt, *Dr. Putt Web Page* (http://www.drputt.com/), pp. 1–3, 2000.
Targaline, *Targaline Putting System Web Page* (http://www.targaline.com), p. 1, Jul. 11, 2001.
Silent Teacher.com, *Sure Stance Golf Alignment Tool Web Page* (http://www.silentteacher.com/), pp. 1–2, Jul. 11, 2000.

*Primary Examiner*—Paul T. Sewell
*Assistant Examiner*—Nini F. Legesse
(74) *Attorney, Agent, or Firm*—Timothy M. Honeycutt

(57) ABSTRACT

Various embodiments of a golf device for use on a putting surface are provided. In one aspect, a golf device for use on a putting surface is provided that includes a ball that has a center and a first outer diameter. First and second annular members are coupled to the ball in substantially parallel spaced-apart relation. The spacing of the first and second annular members defines a spherical zone of the ball that projects radially outwardly from the center beyond the outer peripheral surfaces of the first and second annular members. The first and second diameters of the first and second annular members are sized so that a first portion of the first outer peripheral surface and a second portion of the second outer peripheral surface are positioned substantially at the putting surface. The device provides rapid tactile and visual feedback of a misstroke.

15 Claims, 4 Drawing Sheets

GOLF DEVICE

BACKGROUND OF THE INVENTION

1. Field of the Invention

This invention relates generally to golf devices, and more particularly to a golf putting practice device and methods of making the same.

2. Description of the Related Art

The successful playing of golf requires skill and precision. This is perhaps nowhere more self evident than on the green. Accurate putting involves a combination of judgement, experience, as well as proper hand-eye coordination. Judgement is a matter of assessing the slope, grass condition, grain and distance of the projected roll path of the ball to the cup. Experience enables a player to select a proper back stroke and aim point for the putting stroke. However, merely knowing the anticipated distance and break of a putt based upon an examination of the green and on player experience is not enough to assure an accurate putt. It is still necessary for the player to translate that information and experience into a properly executed putting stroke through proper hand-eye coordination.

In an ideal putting stroke, the face of the putter is approximately normal to the intended initial roll path of the ball at the time the putter face strikes the ball. If the putter head does not squarely impact the ball, that is, the putter head is stroked at an angle relative to the desired initial roll path of the ball, the ball will roll on a path that lies either to the right or to the left of the desired roll path depending upon the angle of the forward movement of the putter head relative to the desired roll path. While it is permissible and even sometimes desirable for the putter head to move upwards as the ball is struck in order to impart a forward roll to the ball, it is conversely highly undesirable for the putter head to exhibit any lateral motion at the time the ball is struck. If the putter head is moving laterally relative to the ball at the time of impact, a torque is applied to the ball which may produce an undesirable spin that causes the roll path to deviate to the right or left depending upon the direction of lateral movement of the putter head at the time of impact.

As with other aspects of putting, the ability to consistently bring the putter head squarely into contact with the ball may be substantially improved through practice. To this end, a number of conventional putter training devices have been developed over the years to assist the golfer in developing a more consistent putting stroke. One conventional design incorporates a pair of spaced-apart wheels connected to a golf ball. The wheels have an outer diameter that is larger than that of the golf ball such that the ball is supported above the putting surface by the wheels. A properly executed putting stroke will, theoretically, bring the face of the putter head squarely into contact with both of the wheels simultaneously and produce a straight, freely rolling movement of the device. Off-axis strokes will theoretically strike one or the other of the wheels first, producing a deviant rolling movement. The difficulty with this design is that it does not provide a realistic tactile feedback to the player. The lack of tactile feedback stems from the fact that the larger outer diameters of the wheels relative to the outer diameter of the ball prevents the putter head from ever actually contacting the ball. Thus, even a properly executed putting stroke will not feel like an actual putt to the golfer.

Another conventional design incorporates a pair of weights connected to a golf ball in spaced-apart relation. The weights are diametrically positioned and designed to provide the ball with a mass moment of inertia through an axis passing through the center of the ball and the weights that is smaller than mass moments of inertia taken along two other axes orthogonal to the axis passing through the center of the ball and the weights. The ball is placed on a putting surface with the axis passing through the weights parallel to the putting surface and perpendicular to the desired roll path of the ball. A correctly stroked putt will, theoretically, cause the ball to roll straight with a rotational axis that corresponds to the axis passing through the weights. Conversely, a misstroked putt will cause the ball to roll unstably as the weights begin to strike the putting surface. The difficulty with this design is that less than instantaneous feedback may be provided as an indicator of an improperly struck putt. A small misstroke may cause the ball to roll some distance before the instability of the ball brings the weights into contact with the putting surface. Furthermore, the weights are intended to be metal slugs that have a density that is much greater than the density of the golf ball itself. Accordingly, the device may be heavier than a regulation golf ball and thus not provide the same tactile response as a regular golf ball.

The present invention is directed to overcoming or reducing the effects of one or more of the foregoing disadvantages.

SUMMARY OF THE INVENTION

In accordance with one aspect of the present invention, a golf device for use on a putting surface is provided that includes a ball that has a center and a first outer diameter. A first annular member is coupled to the ball and has a second outer diameter that is smaller than the first outer diameter. The first annular member has a first outer peripheral surface. A second annular member is coupled to the ball in substantially parallel spaced-apart relation to the first annular member. The second annular member has a third outer diameter that is smaller than the first outer diameter. The second annular member has a second outer peripheral surface. The spacing of the first and second annular members defines a spherical zone of the ball that projects radially outwardly from the center beyond the outer peripheral surfaces of the first and second annular members. The first and second diameters of the first and second annular members are sized so that a first portion of the first outer peripheral surface and a second portion of the second outer peripheral surface are positioned substantially at the putting surface.

In accordance with another aspect of the present invention, a golf device for use on a putting surface is provided that includes a ball that has a center and a first outer diameter. A first annular member is coupled to the ball. The first annular member has a second outer diameter that is smaller than the first outer diameter. The first annular member has a first outer peripheral surface and a first bore through which a first spherical cap portion of the ball projects. A second annular member is coupled to the ball in substantially parallel spacedapart relation to the first annular member. The second annular member has a third outer diameter that is smaller than the first outer diameter. The second annular member has a second outer peripheral surface and second bore through which a second spherical cap portion of the ball projects. The spacing of the first and second annular members defines a spherical zone of the ball that projects radially outwardly from the center beyond the outer peripheral surfaces of the first and second annular members.

In accordance with another aspect of the present invention, an apparatus for securing first and second annular members to a golf ball in substantially parallel spaced-apart relation is provided that includes a first member that has a first recess sized to receive the first annular member with a portion of the first annular member projecting upwardly therefrom. A second member is provided that has a second recess sized to receive the second annular member in a substantially parallel orientation relative the first annular member and with a second portion of the second annular member projecting downwardly therefrom. An alignment guide is coupled to the first and second members for positioning the first and second members in substantially parallel alignment and the first and second annular members in substantially concentric alignment when the first and second members are brought together to sandwich the golf ball between the first and second annular members.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
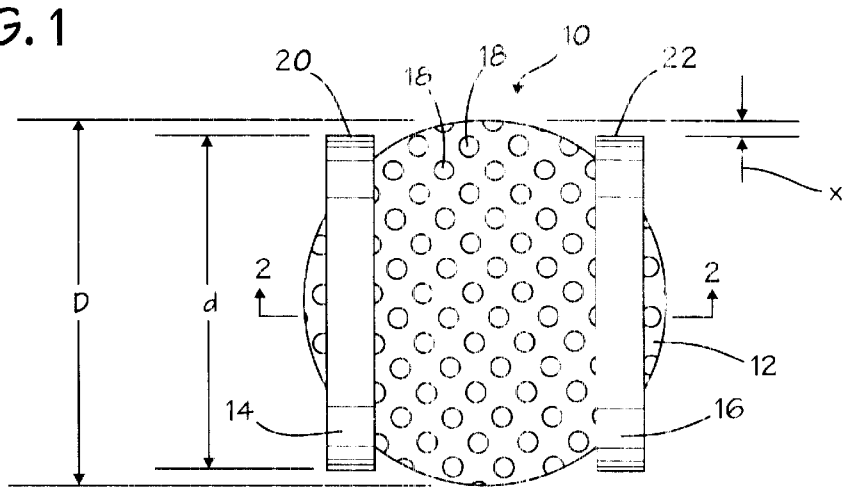
FIG. 1 is a top view of an exemplary embodiment of a golf device in accordance with the present invention.

In the drawings described below, reference numerals are generally repeated where identical elements appear in more than one figure. Turning now to the drawings, and in particular to FIG. 1, therein is shown a top view of an exemplary embodiment of a golf device 10 that includes a ball 12 and a pair of annular members 14 and 16 coupled to the ball in substantially parallel spaced-apart relation. The ball 12 may be a regulation golf ball, and as such, provided with a plurality of external depressions or dimples 18, or may be configured as a ball that approximates the weight and outer diameter characteristics of a regulation golf ball. The ball 12 has an outer diameter D while the annular members 14 and 16 are provided with an outer diameter d that is smaller than the outer diameter D. The annular members 14 and 16 have respective outer peripheral surfaces 20 and 22.

Figure 2:
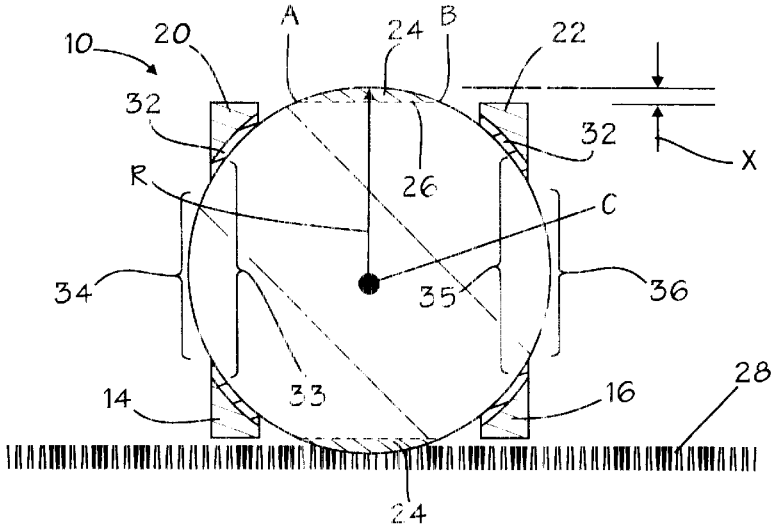
FIG. 2 is a cross-sectional view of FIG. 1 taken at section 2—2 in accordance with the present invention.

FIG. 2 is a cross-sectional view of FIG. 1 taken at section 2—2 and shows the golf device 10 resting on a putting surface 28. The putting surface 28 may be a golf course green, a carpet, rug or virtually any other surface upon which putting practice is performed. As shown in FIG. 2, the outer diameter d of the annular members 14 and 16 is selected so that a spherical zone 24 projects radially outwardly (along a radius R) from the center C of the ball 12 beyond the outer peripheral surfaces 20 and 22 by a distance X which is approximately equal to ½( D-d). The spherical zone 24 is delineated by the arc AB and the dashed line 26 shown in FIG. 2 and extends circumferentially around the entirety of the ball 12 as shown in FIG. 2. The outer diameter d of the annular members 20 and 22 is selected not only to provide the spherical zone 24. In addition, the outer diameter d may be sized so that when the ball 12 is resting on the putting surface 28, the outer peripheral surfaces 20 and 22 of the annular members 14 and 16 are positioned substantially at the putting surface 28. The phrase "substantially at" as used herein is intended to mean just at or just slightly above the putting surface 28.

The annular members 14 and 16 are secured to the ball 12 by an adhesive 32. The adhesive 32 may be a glue, a single or double-sided adhesive tape, or other well-known type of adhesive. In an exemplary embodiment, the adhesive 32 consists of a double-sided adhesive tape.

The annular member 14 may be provided with a bore 33 through which a portion or spherical cap 34 of the ball 12 projects. The annular member 16 may be similarly provided with a bore 35 through which a portion or spherical cap 36 of the ball 12 projects. The bores 33 and 35 reduce the overall weight of the annular members 14 and 16. Further weight reduction may be realized by fabricating the annular members 14 and 16 from relatively lightweight materials, such as, for example, polyurethane, natural or synthetic rubbers, or the like. Light weight is desirable in order to minimize the impact of the presence of the annular members 14 and 16 on the mass moment of inertia of the ball 12.

Figure 3:
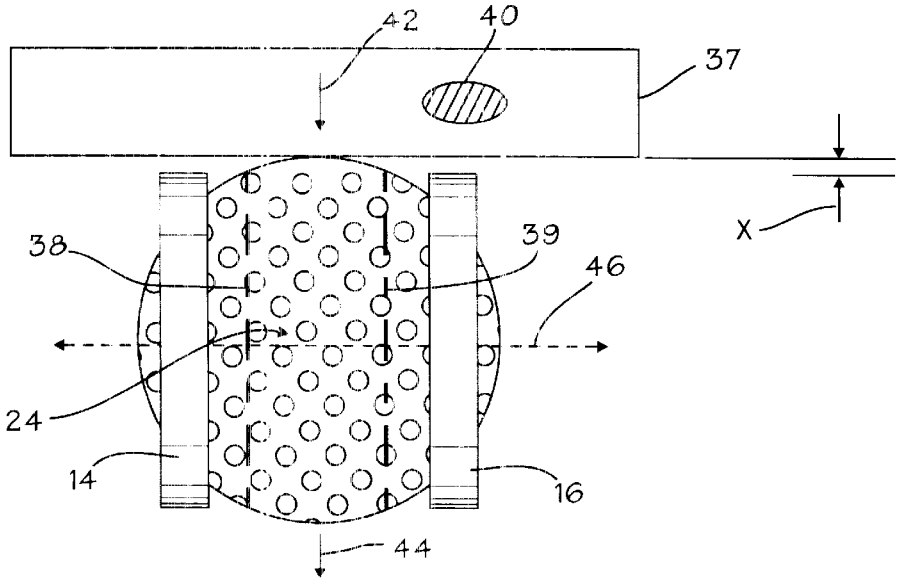
FIG. 3 is a top view of the golf device of FIG. 1 at the moment of impact with a putter head in accordance with the present invention.

The spherical zone constitutes the desired hitting area or "sweet spot" for the ball 12. Thus, a correctly stroked putt will bring a putter head into contact with the spherical zone 24 in a substantially normal orientation, and thus not strike either of the annular members 14 or 16. This type of correctly performed putting stroke is illustrated in FIG. 3, which is a top view of the golf device 10 and shows a putter head 37 coming into contact with the spherical zone 24, visible as the region between the dashed lines 38 and 39. The shaft 40 of the putter 34 is shown cross-hatched. The direction of the putting stroke is shown by the arrow 42. Since the putter head 37 comes into contact in the direction of the arrow 42, a clean hit results and the golf device 10 rotates in the direction of the arrow 44 around a rotational axis 46. The rotational axis will be approximately concentric with the bores 33 and 35 of the annular members 14 and 16.

Figure 4:
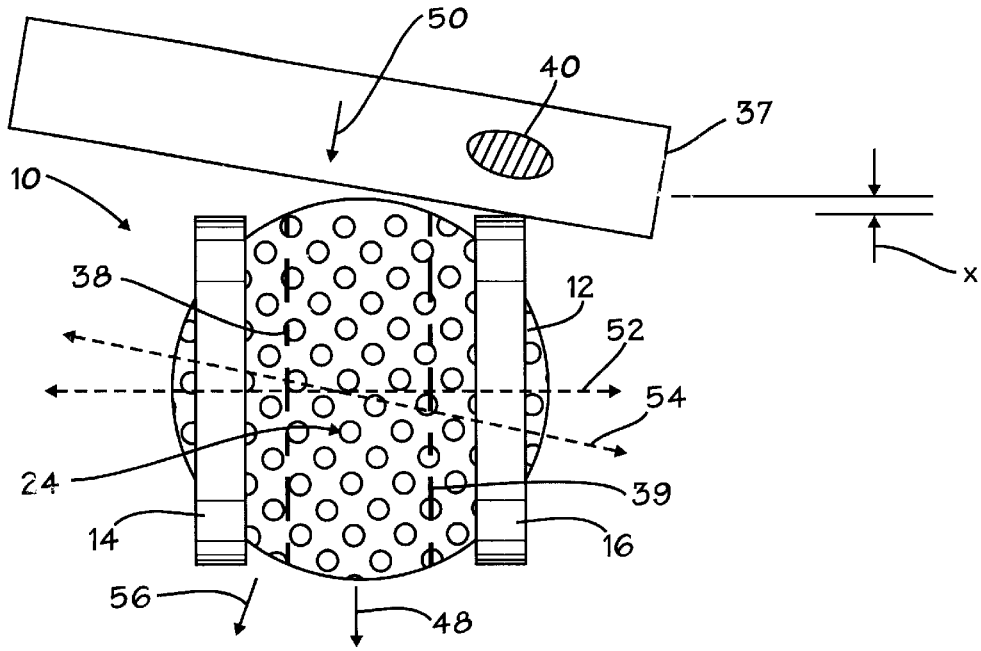
FIG. 4 is a top view of the golf device at the moment of impact with a putter head in misalignment with the desired path of the device in accordance with the present invention.

One type of common putting stroke error is illustrated in FIG. 4, which is a top view of the golf device 10 and the putter 34. In this illustration, the desired direction of travel for the golf device 10 is indicated by the arrow 48. However, the putter 37 is stroked incorrectly and at an angle with respect to the golf device 10 as indicated by the arrow 50. The desired axis of rotation for the device 10 is indicated by the dashed line 52. As a result of the poor and/or improper position of the putter 37, the outer peripheral surface 22 of the annular member 16 is contacted instead of the spherical zone 24. The putter contact with the annular member 16 causes the golf device 10 to rotate about a rotational axis 54 instead of the desired rotational axis 52 and roll in the direction of the arrow 56. As the golf device 10 rotates about the rotational axis 54, the annular member 14 almost immediately comes into contact with the underlying putting surface (not shown in FIG. 4), resulting in a tumbling of the golf device 12. The golf device 10 provides immediate feedback to the golfer as to the character of the misstroke in two ways. First, the normal tactile feel of the putter head 37 striking the outer surface of the ball 12 at the spherical zone 24 is not produced. Instead, an unexpected tactile response is provided by the contact between the putter 34 and the annular members 16. The second rapid feedback is provided by way of the almost instantaneous tumbling motion of the golf device 10 that brings the annular members 14 and 16 into repeated contact with the putting surface. The quick tumbling is made possible by the close proximity of the outer peripheral surfaces 20 and 22 of the annular members 14 and 16 to the putting surface 28 (See FIG. 2).

Figure 5:
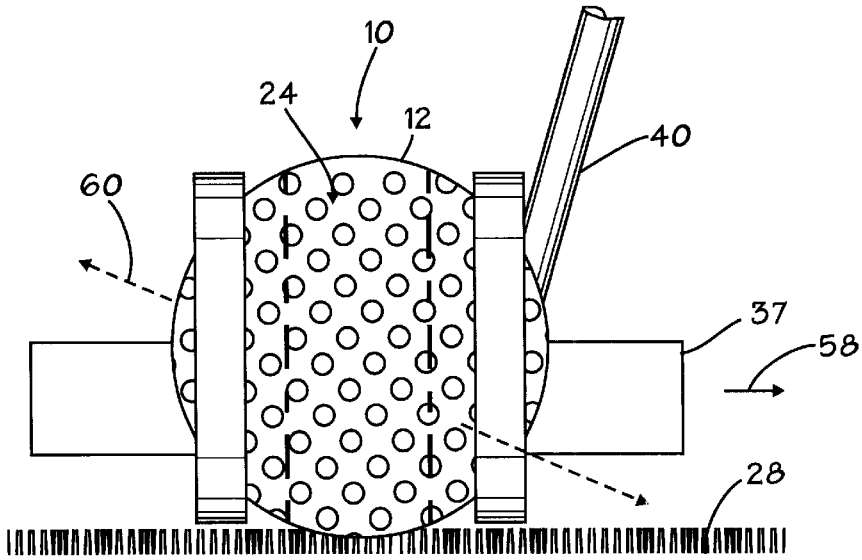
FIG. 5 is a front view of the golf device at the moment of impact with the putter head and depicts another type of misstroke scenario in accordance with the present invention.
Figure 6:
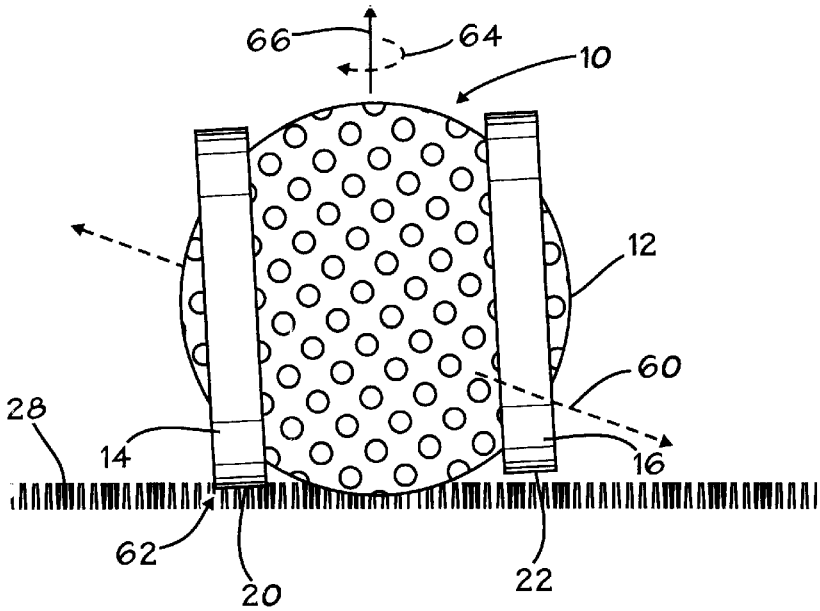
FIG. 6 is a front view like FIG. 5 depicting the golf device momentarily after the impact with the putter head in accordance with the present invention.
Figure 7:
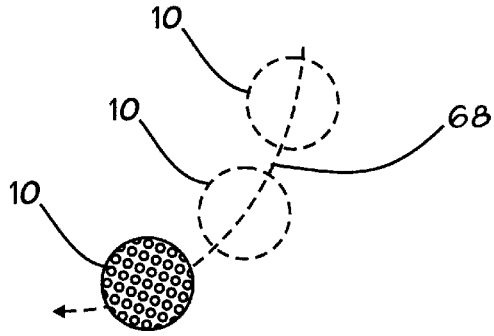
FIG. 7 is a schematic top view of a possible roll path of the golf device following the misstroke depicted in FIG. 5 in accordance with the present invention.

Another type of common putting mistake is illustrated in FIGS. 5, 6 and 7. FIG. 5 is a front view of the golf device 10 at the instant the putter 37 impacts the ball 12. In this illustration, the putter 37 is brought into contact with the ball 12 with a sliding action as indicated by the arrow 58. Although the putter 37 strikes the spherical zone 24 of the ball 12, the lateral motion of the putter 37 causes the golf device 10 to roll about the rotational axis 60.

FIG. 6 shows a front view of the golf device 10 shortly after the contact by the putter 37. As a result of the rotation of the golf device 10 about the rotational axis 60, the annular member 14, and particularly the lower outer corner 62 thereof, quickly comes into contact with the putting surface 28. The contact between the outer peripheral surface 20 of the annular member 14 and the putting surface 28 produces a dramatic drag upon the rotational motion of the golf device 12. As a result, the golf device 12 will exhibit significant rotation in the direction of the arrow 64 about an axis 66. The rotation in the direction of the arrow 64 in conjunction with the forward motion of the golf device 10, produces a markedly curved path as shown by the dashed line 68 in the overhead view of FIG. 7.

Figure 8:
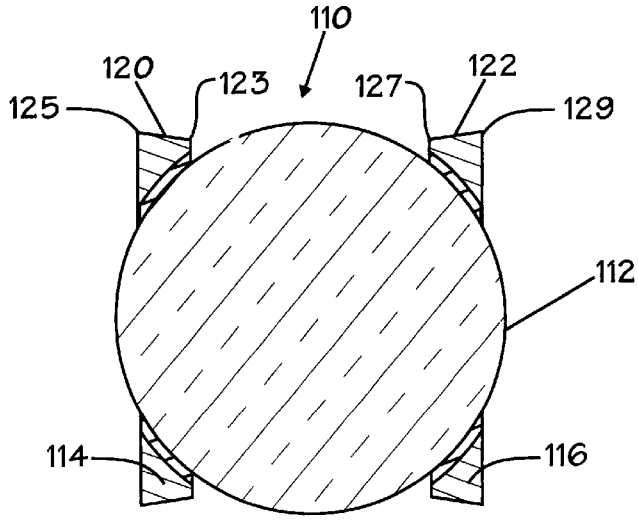
FIG. 8 is a cross-sectional view like FIG. 2 of an alternate exemplary embodiment of the golf device in accordance with the present invention.

In the foregoing illustrative embodiments, the outer peripheral surfaces 20 and 22 of the annular members 14 and 16 are substantially flat. However, other arrangements are envisioned. FIG. 8 depicts an alternate illustrative embodiment of the golf device, now designated 110. The golf device 110 includes a ball 112 of the type described elsewhere herein and first and second annular members 114 and 116 coupled to the ball 112 in substantially parallel spaced-apart relation. The annular members 114 and 116 are provided with respective outer peripheral surfaces 120 and 122. In this illustrative embodiment, the outer peripheral surfaces 120 and 122 are tapered. In this regard, the outer diameter of the annular member 114 at an inner edge 123 is smaller than the outer diameter of the annular member 114 at an outer edge 125 thereof. Similarly, the outer diameter of an inner edge 127 of the annular member 122 is smaller than the outer diameter of an outer edge 129 thereof. Like the other illustrative embodiments disclosed herein, an adhesive 132 is used to secure the annular members 114 and 116 to the ball 112.

Figure 9:
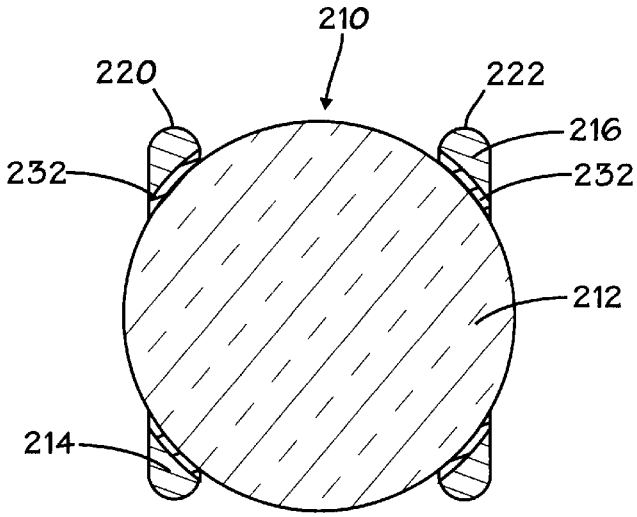
FIG. 9 is a cross-sectional view like FIG. 2 of another alternate exemplary embodiment of the golf device in accordance with the present invention.

Another alternate exemplary embodiment is disclosed in FIG. 9. In this embodiment, the golf device 210 includes a ball 212 and first and second annular members 214 and 216 coupled thereto in substantially parallel spaced-apart relation. In this illustrative embodiment, the outer peripheral surfaces 220 and 222 of the annular members 214 and 216 are rounded. Like the other illustrative embodiments disclosed herein, the annular members 214 and 216 may be secured to the ball 212 by an adhesive 232.

Figure 10:
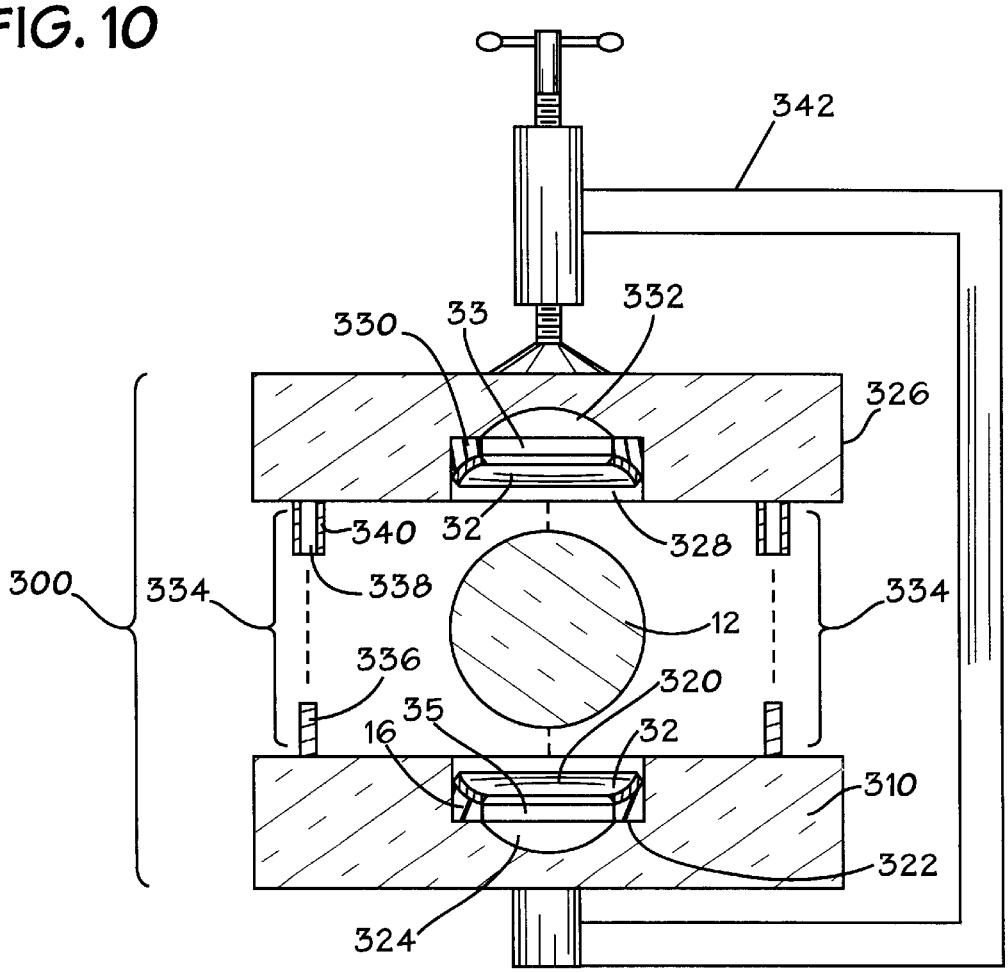
FIG. 10 is a cross-sectional view of an apparatus for assembling a golf device in accordance with the present invention.
Figure 1:
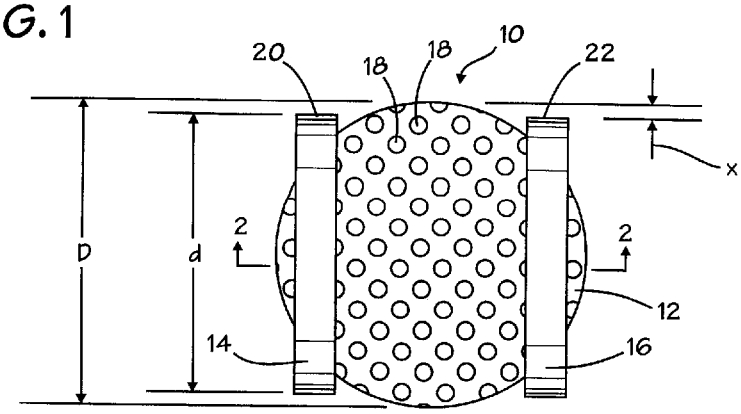
Figure 2:
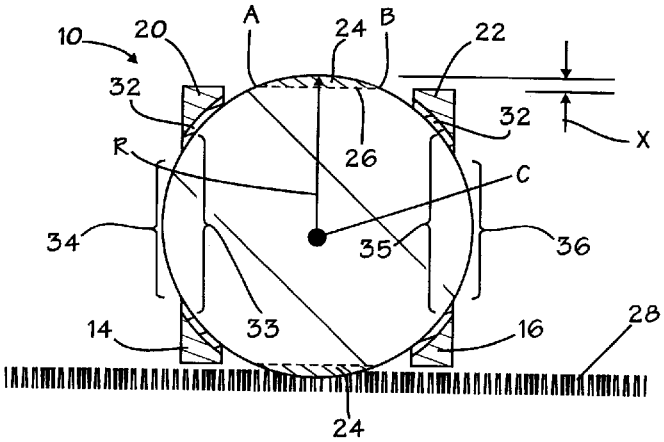
Figure 3:
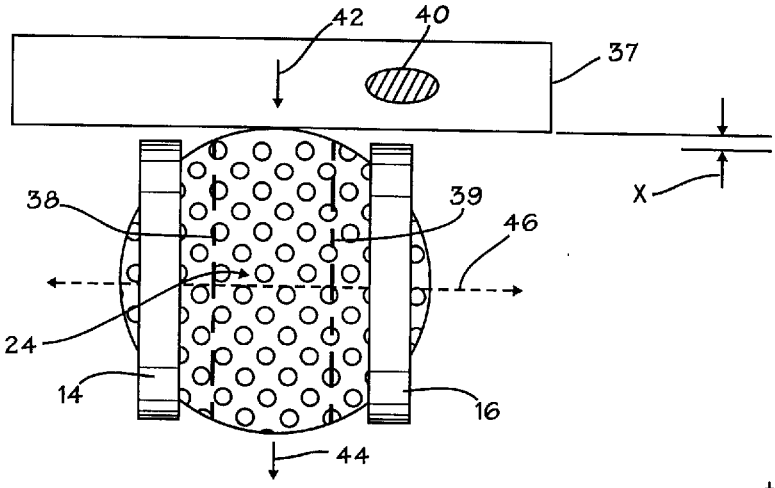

An apparatus 300 for assembling any of the embodiments of the golf device disclosed herein, may be understood by referring now to FIG. 10, which is an exploded cross-sectional view of the apparatus 300. The apparatus 300 consists of a first member 310 that is provided with a first recess 320. The first recess 320 has an upwardly facing annular shoulder 322 that is designed to enable the annular member 16 to seat thereon. The lower portion of the recess 320 is dished at 324 to allow clearance for a portion of the ball 12 to project through the bore 35 of the annular member 16. A second member 326 is provided that is essentially a mirror image of the member 310. Thus, the member 326 includes a recess 328 that is fashioned with a downwardly facing annular shoulder 330 sized to allow the annular member 14 to be seated thereon. The recess 328 is dished at 332 to provide clearance for a portion of the ball 12 that projects through the bore 33 of the annular member 14 when the ball 12 is sandwiched between the annular members 14 and 16.

At least one alignment guide 334 is provided for positioning the first and second members 310 and 326 in substantially parallel alignment when the members 310 and 326 are brought together to sandwich the ball 12 between the annular members 14 and 16. The alignment guide 334 consists of a member 336 that is sized to slidably fit within a bore 338. The bore 338 may be provided in a member 340 as shown or may be formed in the member 326 itself. The purpose of the alignment guide 334 is to not only produce a substantially parallel alignment of the members 310 and 326 but also prevent relative lateral movement there between. Note that a second alignment guide 334 is provided in spaced-apart relation to the left most alignment guide depicted. Indeed, it is envisioned that better stability and parallel alignment between the members 310 and 326 will be achieved if there are at least three such alignment guides 334 arranged in a triangular pattern.

Assembly of the golf device 10 is accomplished by seating the annular member 16 in the recess 320. The adhesive 32 may be applied to the annular member 16 at this time or before insertion. The annular member 14 is seated in the recess 328 in like fashion. The ball 12 is then seated on the annular member 16 and the members 310 and 326 are brought together to sandwich the ball 12 between the substantially concentric annular members 14 and 16. If the adhesive requires a curing period, the members 310 and 326 and may be held in place by a clamp 342 and later removed when the adhesive 32 has cured.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A golf device for use on a putting surface, comprising:

a ball having a center and a first outer diameter;

a first annular member coupled to the ball and having a second outer diameter smaller than the first outer diameter and a first outer peripheral surface; and a second annular member coupled to the ball in substantially parallel spaced-apart relation to the first annular member, the second annular member having a third outer diameter smaller than the first outer diameter and a second outer peripheral surface, the spacing of the first and second annular members defining a spherical zone of the ball projecting radially outwardly from the center beyond the outer peripheral surfaces of the first and second annular members, the first and second diameters of the first and second annular members being sized so that a first portion of the first outer peripheral surface and a second portion of the second outer peripheral surface being positioned substantially at the putting surface.

2. The golf device of claim 1, wherein the ball comprises a regulation golf ball.

3. The golf device of claim 1, wherein the first and second annular members comprise rings.

4. The golf device of claim 1, wherein the first and second outer peripheral surfaces comprise flat surfaces.

5. The golf device of claim 4, wherein the first and second annular members being concentric relative to a central axis, the first and second outer peripheral surfaces being slanted relative to the central axis.

6. The golf device of claim 1, wherein the first and second annular members being coupled to the ball by an adhesive.

7. The golf device of claim 6, wherein the adhesive comprises an adhesive tape.

8. A golf device for use on a putting surface, comprising:

a ball having a center and a first outer diameter;

a first annular member coupled to the ball, the first annular member having a second outer diameter smaller than the first outer diameter, a first outer peripheral surface, and a first bore through which a first spherical portion of the ball projects; and a second annular member coupled to the ball in substantially parallel spaced-apart relation to the first annular member, the second annular member having a third outer diameter smaller than the first outer diameter, a second outer peripheral surface, and second bore through which a second spherical portion of the ball projects, the spacing of the first and second annular members defining a spherical zone of the ball projecting radially outwardly from the center beyond the outer peripheral surfaces of the first and second annular members.

9. The golf device of claim 8, wherein the first and second diameters of the first and second annular members being sized so that a first portion of the first outer peripheral surface and a second portion of the second outer peripheral surface being positioned substantially at the putting surface.

10. The golf device of claim 8, wherein the ball comprises a regulation golf ball.

11. The golf device of claim 8, wherein the first and second annular members comprise rings.

12. The golf device of claim 8, wherein the first and second outer peripheral surfaces comprise flat surfaces.

13. The golf device of claim 12, wherein the first and second annular members being concentric relative to a central axis, the first and second outer peripheral surfaces being slanted relative to the central axis.

14. The golf device of claim 8, wherein the first and second annular members being coupled to the ball by an adhesive.

15. A golf device for use on a putting surface, comprising:

a ball having a center and a first outer diameter;

a first ring coupled to the ball and having a second outer diameter smaller than the first outer diameter and a first outer peripheral surface; and a second ring coupled to the ball in substantially parallel spaced-apart relation to the first ring, the second ring having a third outer diameter smaller than the first outer diameter and a second outer peripheral surface, the spacing of the first and second rings defining a spherical zone of the ball projecting radially outwardly from the center beyond the outer peripheral surfaces of the first and second rings, the first and second diameters of the first and second rings being sized so that a first portion of the first outer peripheral surface and a second portion of the second outer peripheral surface being positioned substantially at the putting surfaces.

* * * * *

UNITED STATES PATENT AND TRADEMARK OFFICE

CERTIFICATE OF CORRECTION

PATENT NO. : 6,511,384 B1
DATED : January 28, 2003
INVENTOR(S) : Adrian V. Villacorta It is certified that error appears in the above-identified patent and that said Letters Patent is hereby corrected as shown below:

Title page, should be deleted to be replaced with the illustrative figure, as shown on the attached page.

Drawing sheet 1 of 4, should be deleted to be replaced with the drawing sheet consisting of Figs. 1-3 as shown on the attached page.

Signed and Sealed this

Twentieth Day of May, 2003

JAMES E. ROGAN
*Director of the United States Patent and Trademark Office*

(12) United States Patent
Villacorta

(10) Patent No.: US 6,511,384 B1
(45) Date of Patent: Jan. 28, 2003

(54) GOLF DEVICE

(76) Inventor: Adrian V. Villacorta, 4106 Birchton, Houston, TX (US) 77080

( * ) Notice: Subject to any disclaimer, the term of this patent is extended or adjusted under 35 U.S.C. 154(b) by 0 days.

(21) Appl. No.: 09/981,196

(22) Filed: Oct. 15, 2001

(51) Int. Cl.[7] ..... A63B 53/06
(52) U.S. Cl. ..... 473/257; 473/200
(58) Field of Search ..... 473/200, 569, 473/257, 351, 595

(56) References Cited

U.S. PATENT DOCUMENTS

| | | | | |
|---|---|---|---|---|
| 2,884,254 | A | 4/1959 | Miner | 273/183 |
| D220,769 | S | 5/1971 | LaHue | D34/5 |
| D259,111 | S | 5/1981 | Kinney | D11/157 |
| 4,278,254 | A | 7/1981 | Simjian | 273/183 |
| 4,402,511 | A | 9/1983 | Simjian | 273/183 |
| D273,031 | S | 3/1984 | Simjian | D21/234 |
| 4,494,757 | A | 1/1985 | Simjian | 273/183 |
| 4,664,387 | A | 5/1987 | Tardiff | 273/183 |
| 5,013,046 | A | 5/1991 | Koch | 273/213 |
| D385,937 | S | 11/1997 | Lee | D21/234 |
| D386,548 | S | 11/1997 | Cullen, III | D21/205 |
| D411,268 | S | 6/1999 | Sullivan | D21/709 |
| D411,599 | S | 6/1999 | Sullivan | D21/709 |
| 5,916,044 | A | 6/1999 | Shimosaka et al. | 473/384 |
| 6,001,033 | A | 12/1999 | Tucker | 473/409 |
| 6,004,220 | A | 12/1999 | Razanno | 473/200 |
| 6,019,685 | A | 2/2000 | Fonseca et al. | 473/265 |
| 6,129,639 | A | 10/2000 | Brock et al. | 473/260 |
| 6,155,569 | A | 12/2000 | Horiuchi et al. | 273/317 |
| 6,162,136 | A | 12/2000 | Aoyama | 473/383 |
| 6,179,721 | B1 | 1/2001 | Bevan | 473/160 |
| 6,179,727 | B1 | 1/2001 | Giordano | 473/330 |
| 6,197,721 | B1 | 3/2001 | Didillon et al. | 502/326 |
| 6,231,459 | B1 | 5/2001 | Pettigrew et al. | 473/351 |
| 6,248,021 | B1 | 6/2001 | Ognjanovic | 473/131 |
| 6,248,022 | B1 | 6/2001 | Steyn | 473/162 |

OTHER PUBLICATIONS

Rockline, Inc., *Rockline™ Putting Trainer Web Page* (http://www.puttingtrainer.com/), pp. 1–3, 2000.
MatchPlay, Inc., *Putting Mat Web Page* (http://www.puting-mat.com), p. 1, 1997.
Boom, Golf, *Boomerang Ball Returner Web Page* (http://www.boomgolf.com/main.html), p. 1, Jul. 1, 2000.
Dr. Putt, *Dr. Putt Web Page* (http://www.drputt.com/), pp. 1–3, 2000.
Targaline, *Targaline Putting System Web Page* (http://www.targaline.com), p. 1, Jul. 11, 2001.
Silent Teacher.com, *Sure Stance Golf Alignment Tool Web Page* (http://www.silentteacher.com/), pp. 1–2, Jul. 11, 2000.

*Primary Examiner*—Paul T. Sewell
*Assistant Examiner*—Nini F. Legesse
(74) *Attorney, Agent, or Firm*—Timothy M. Honeycutt

(57) ABSTRACT

Various embodiments of a golf device for use on a putting surface are provided. In one aspect, a golf device for use on a putting surface is provided that includes a ball that has a center and a first outer diameter. First and second annular members are coupled to the ball in substantially parallel spaced-apart relation. The spacing of the first and second annular members defines a spherical zone of the ball that projects radially outwardly from the center beyond the outer peripheral surfaces of the first and second annular members. The first and second diameters of the first and second annular members are sized so that a first portion of the first outer peripheral surface and a second portion of the second outer peripheral surface are positioned substantially at the putting surface. The device provides rapid tactile and visual feedback of a misstroke.

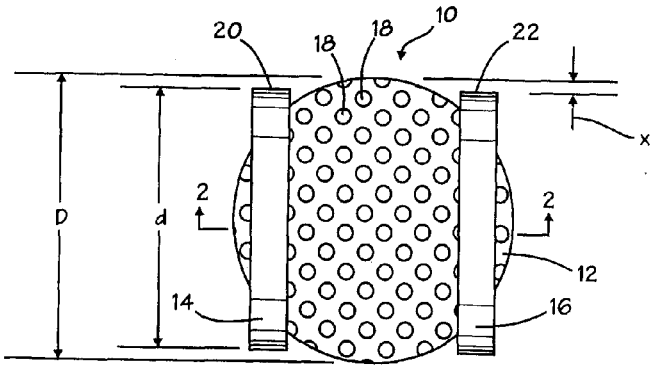

15 Claims, 4 Drawing Sheets